US012485465B2

(12) United States Patent
Nakamura et al.

(10) Patent No.: US 12,485,465 B2
(45) Date of Patent: Dec. 2, 2025

(54) OVERLAPPED BLANK AND MOLDING METHOD THEREOF

(71) Applicant: KOBE STEEL, LTD., Hyogo (JP)

(72) Inventors: Shuki Nakamura, Kobe (JP); Kenichi Watanabe, Kobe (JP)

(73) Assignee: KOBE STEEL, LTD., Hyogo (JP)

( * ) Notice: Subject to any disclaimer, the term of this patent is extended or adjusted under 35 U.S.C. 154(b) by 263 days.

(21) Appl. No.: 18/050,762

(22) Filed: Oct. 28, 2022

(65) Prior Publication Data

US 2023/0191468 A1 Jun. 22, 2023

(30) Foreign Application Priority Data

Nov. 24, 2021 (JP) ..... 2021-190423

(51) Int. Cl.
*B21D 22/22* (2006.01)

(52) U.S. Cl.
CPC ..... *B21D 22/22* (2013.01)

(58) Field of Classification Search
CPC ..... B21D 22/20; B21D 22/22; B21D 22/26
USPC ..... 72/363
See application file for complete search history.

(56) References Cited

FOREIGN PATENT DOCUMENTS

| | | | | | |
|---|---|---|---|---|---|
| JP | H07-232223 | A | | 9/1995 | |
| JP | 2000-197969 | A | | 7/2000 | |
| JP | 2020-131226 | A | | 8/2020 | |
| JP | 2020-175400 | A | | 10/2020 | |
| JP | 2022129059 | A | * | 9/2022 | ..... B21D 22/26 |

* cited by examiner

*Primary Examiner* — Debra M Sullivan
(74) *Attorney, Agent, or Firm* — Studebaker Brackett PLLC

(57) ABSTRACT

A molding method of an overlapped blank includes: preparing an overlapped blank including a first metal plate including a bulged excess portion, a first flat portion provided adjacent to the excess portion, and a second flat portion provided adjacent to the excess portion on an opposite side to the first flat portion, a flat second metal plate overlapped on the first flat portion and the second flat portion, a first joint portion where the first flat portion and the second metal plate are joined to each other, and a second joint portion where the second flat portion and the second metal plate are joined to each other; and bending the overlapped blank with the first metal plate being directed to an outer side of the bending of the overlapped blank.

5 Claims, 14 Drawing Sheets

OVERLAPPED BLANK AND MOLDING METHOD THEREOF

CROSS-REFERENCE TO RELATED APPLICATIONS

This application claims priority of Japanese Patent Application No.: 2021-190423 filed on Nov. 24 2021 the content of which is incorporated herein by reference.

BACKGROUND OF THE INVENTION

Technical Field

The present invention relates to an overlapped blank and molding method thereof.

Related Art

A technique of manufacturing a frame member of an automobile through press molding of a metal plate has generally been known. For such a frame member of an automobile, a metal plate having a partially increased plate thickness may be press-molded for weight reduction, cost reduction, and increased strength.

Japanese Patent Application Laid-Open No. 2000-197969 A discloses a molding method of forming an overlapped blank in which a first metal plate and a second metal plate are overlapped and overlapped portions are joined by a line welding, and press-molding the overlapped blank into a hat shape.

SUMMARY

In the method for press-molding an overlapped blank disclosed in JP 2000-197969 A, since the first metal plate and the second metal plate are already bound at the joint portion at the moment of press-molding, a member on the inner side of the bending tends to be compressed and a member on the outer side tends to be tensioned at the time of bending, due to line length difference. Consequently, a shear stress is generated at the joint portion, leading to rupture of the joint portion. In addition, when the load is removed and the product is released after the bending, elastic recovery that restores the shape, so-called springback, is caused, and the shape of the press-molded product may not match the desired shape.

An objective of the present invention is, with regard to an overlapped blank and molding method thereof, to avoid rupture of a joint portion and suppress springback during press molding for bending the overlapped blank including a plurality of overlapped and joined metal plates.

A first aspect of the present invention provides an overlapped blank comprising: a first metal plate including a bulged excess portion, a first flat portion provided adjacent to the excess portion, and a second flat portion provided adjacent to the excess portion on an opposite side to the first flat portion; a flat second metal plate overlapped on the first flat portion and the second flat portion; a first joint portion where the first flat portion and the second metal plate are joined to each other, and a second joint portion where the second flat portion and the second metal plate are joined to each other.

According to the present invention, since the excess portion is provided between the joint portions, strain caused by line length difference between the joint portions of the first metal plate and the second metal plate is absorbed by deformation of the excess portion during press molding for bending the overlapped blank, whereby shear stress generated at the joint portion can be reduced and rupture of the joint portion is avoided. In addition, since the first metal plate is deformed due to extension of the excess portion at the time of the bending, tensile stress due to the bending is suppressed as compared with a case where no excess portion is provided, and springback can be suppressed. Furthermore, due to crush and deformation of the excess portion, compressive stress is generated in the first metal plate. This compressive stress cancels a part of the tensile stress of the first metal member that causes the springback, whereby the springback of the overlapped blank can be further suppressed.

Since the second metal plate is bound by the first metal plate, at the time of deformation of the excess portion during the bending, in addition to compressive stress generated during the bending, tensile stress due to follow-up to the deformation of the excess portion of the first metal plate is generated in the second metal plate. This tensile stress cancels a part of the compressive stress of the second metal plate that causes the springback, whereby the springback of the overlapped blank is suppressed.

In addition, the tensile stress generated in the second metal plate suppresses bending deformation of the second metal plate in the compression direction between the joint portions of the overlapped blank, whereby a gap is generated between the second metal plate and the mold facing the second metal plate.

Thereafter, as the bending deformation progresses, the second metal plate is deformed by the mold toward an inner side in the width direction so that the gap is disappeared. Consequently, the tensile stress is further generated on the surface of the second metal plate on the inner side of the bending, canceling a part of the compressive stress of the second metal plate that causes the springback, whereby the springback of the overlapped blank is further suppressed.

A second aspect of the present invention provides a molding method of an overlapped blank including: preparing an overlapped blank comprising a first metal plate including a bulged excess portion, a first flat portion provided adjacent to the excess portion, and a second flat portion provided adjacent to the excess portion on an opposite side to the first flat portion, a flat second metal plate overlapped on the first flat portion and the second flat portion, a first joint portion where the first flat portion and the second metal plate are joined to each other, and a second joint portion where the second flat portion and the second metal plate are joined to each other; and bending the overlapped blank with the first metal plate being directed to an outer side of the bending of the overlapped blank.

According to the present invention, it is possible to obtain an effect similar to that produced upon press molding for bending the overlapped blank.

The line length increase due to the provision of the excess portion is preferably set to be larger than the difference between the line length change margin of the first metal plate and the line length change margin of the second metal plate before and after the bending.

According to this configuration, since the length of the excess portion is set to be larger than the line length change margin before and after bending of the first metal plate, the excess portion remaining after the line length change is compressively deformed by the mold. Consequently, since compressive stress is generated in the first metal plate in addition to the tensile stress generated by the bending, a part of the tensile stress of the first metal plate that causes springback is canceled by the compressive stress, whereby the springback of the overlapped blank is suppressed.

The length of the excess portion preferably satisfies the following relationship.

$$L0+0.65(t1+t2) \leq L1 \leq L0+1.35(t1+t2) \quad \text{[Math. 1]}$$

L0: a linear distance of the excess portion

L1: a length of the excess portion t1: a plate thickness of the first metal plate t2: a plate thickness of the second metal plate According to this configuration, since the length of the excess portion can be appropriately set, it is possible to suppress the springback of the overlapped blank while avoiding the rupture of the joint portion. Specifically, when the length of the excess portion is less than L0+0.65 (t1+t2), it is difficult to obtain a favorable effect of suppressing rupture of the joint portion and springback. When the length of the excess portion is greater than L0+1.35 (t1+t2), the excess portion of the first metal plate excessively remains, and when the excess portion is deformed to a predetermined shape, a shear stress is generated in the joint portion between the first metal plate and the second metal plate, and the joint portion may be ruptured.

The first metal plate and the second metal plate may be steel plates.

According to the present configuration, due to applying the configuration of the present invention to a steel plate having high tensile strength in which rupture of a joint portion due to an increase in processing pressure during the pressing and springback tend to increase, the effect is suitably exerted.

The first metal plate and the second metal plate may be high-tensile steel plates.

According to the present configuration, due to applying the configuration of the present invention to a high-tensile steel plate having high tensile strength in which rupture of a joint portion due to an increase in processing pressure during the pressing and springback tend to increase, the effect is more suitably exerted.

The first metal plate and the second metal plate may be joined by spot welding.

According to the present configuration, even in a case of spot welding in which the strength of the joint portion is lower than that of line welding or the like, rupture of the joint portion can be suppressed, whereby the cost can be reduced as compared with line welding.

In the bending, it is preferred to prepare a punch having a punch shoulder portion with a convex shape for forming a shoulder portion of a molded article and a die having, in an inner portion, a die shoulder portion with a concave shape corresponding to the convex shape, arrange at least a part of the excess portion of the overlapped blank so as to overlap the punch shoulder portion of the punch, and lower the die in a relative manner to the punch.

According to this configuration, by disposing the excess portion at the punch shoulder portion where the line length change is great, achievement of the absorption of the line length change and the reduction of the tensile stress by the excess portion is more likely.

Advantageous Effects of Invention

According to the overlapped blank and the molding method thereof according to the present invention, it is possible to avoid rupture of the joint portion and suppress springback at the time of press molding for bending a blank including a plurality of metal plates overlapped and joined.

DETAILED DESCRIPTION OF THE PREFERRED EMBODIMENT

In the following, an embodiment of the present invention is described with reference to the accompanying drawings.

A method for molding an overlapped blank according to an embodiment of the present invention is to obtain a press-molded product having a desired shape by press-molding an overlapped blank obtained by overlapping and joining a first metal plate and a second metal plate. This method can be used in particular for forming vehicle body components constituting the vehicle body framework of an automobile. Hereinafter, a method of molding a vehicle body component having a hat-shaped cross section using the present method is described.

Figure 1:
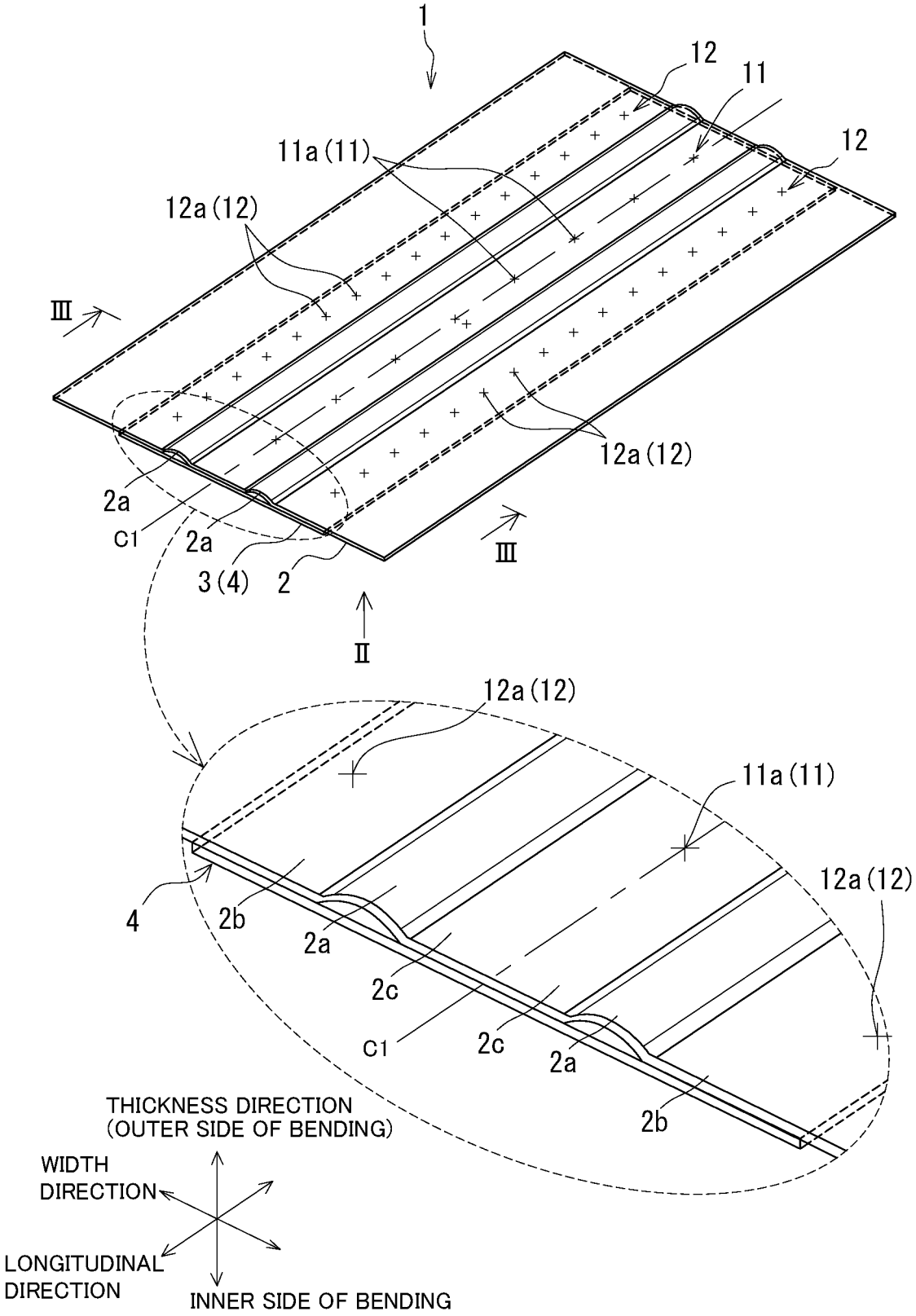
FIG. 1 is a perspective view illustrating an overlapped blank prior to bending.
Figure 2:
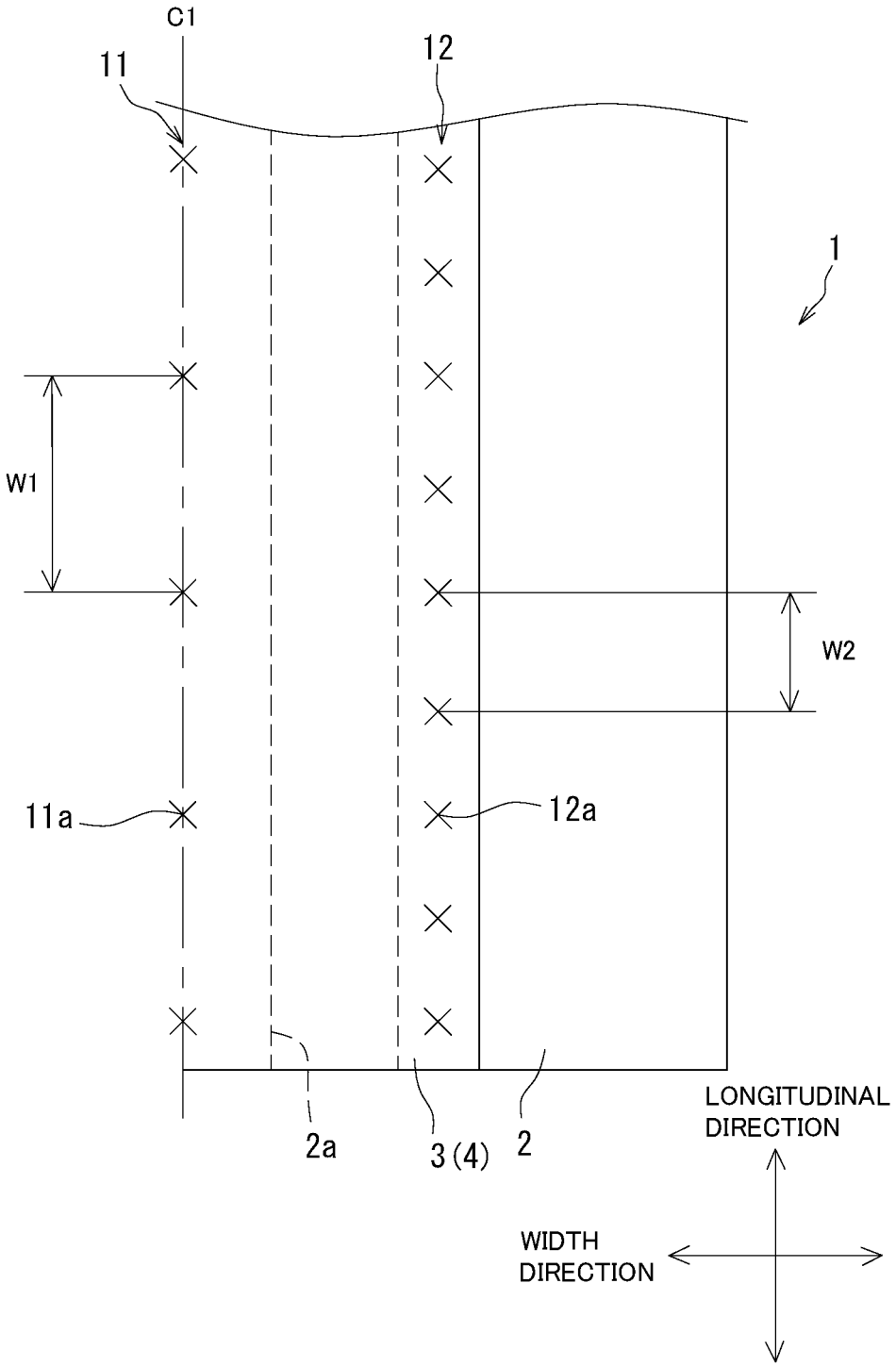
FIG. 2 is an enlarged bottom view as viewed in a direction of an arrow II in FIG. 1.
Figure 3:
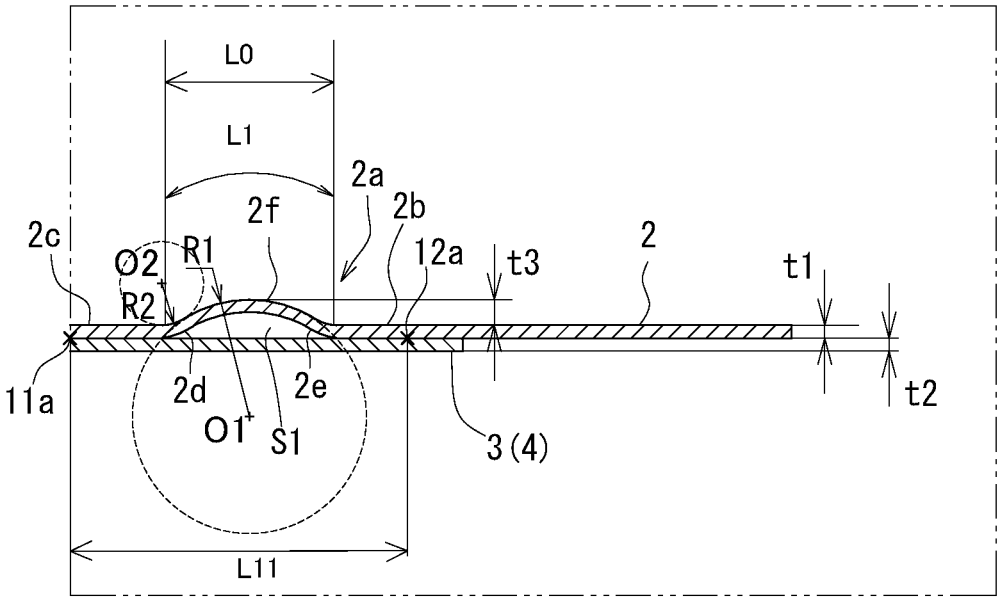
FIG. 3 is a partially enlarged cross-sectional view taken along a line III-III in FIG. 1.
Figure 3:
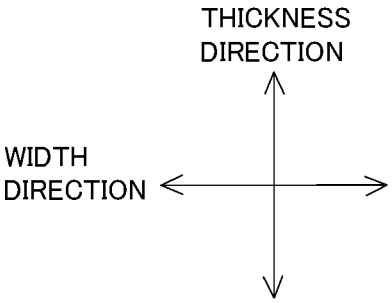

FIGS. 1 to 3 show an overlapped blank 1 according to the embodiment of the present invention. With reference to FIG. 1, the overlapped blank 1 includes a main body member 2 (first metal plate) made of a metal plate having a uniform plate thickness, and a reinforcing member 3 (second metal plate) made of a metal plate having a uniform plate thickness. In the present embodiment, the main body member 2 and the reinforcing member 3 are, for example, so-called high-tensile steel plates having a tensile strength of 590 MPa or more.

With reference to FIG. 1, the main body member 2 includes, on both sides of a center line C1 in the width direction, a bulged excess portion 2*a*, a first flat portion 2*b* provided adjacent to the excess portion 2*a*, and a second flat portion 2*c* provided adjacent to the excess portion 2*a* on an opposite side to the first flat portion 2*b*. The reinforcing member 3 is overlapped on the first flat portion 2*b* and the second flat portion 2*c*. The excess portion 2*a* is formed by bending the main body member 2 so as to protrude to an outer side of the bending, and extends in the longitudinal direction. Specifically, the excess portion 2*a* continuously extends from one end to the other end in the longitudinal direction of the main body member 2.

The reinforcing member 3 is partially overlapped and joined to the inner side of the main body member 2 (the inner side of the bending upon the press molding of the overlapped blank 1) as necessary, to form the overlapped blank 1. In the overlapped blank 1 of the present embodiment, the position of a central portion of the reinforcing member 3 in the width direction coincides with the position of a central portion of the main body member 2 in the width direction.

In the present embodiment, the reinforcing member 3 is smaller in width than the main body member 2 and has the same longitudinal length as the main body member 2. A region of the overlapped blank 1 where the main body member 2 and the reinforcing member 3 are overlapped is hereinafter also referred to as an overlapped portion 4. In the overlapped blank 1, the thickness of the central portion where the overlapped portion 4 is provided is greater than the thickness of both end portions in the width direction, whereby the strength is increased.

As shown in FIG. 1, the overlapped blank 1 has a first joint portion 11 located at the central portion in the width direction of the overlapped portion 4 (reinforcing member 3) and the second joint portion 12 provided at both ends in the width direction of the overlapped portion 4 (reinforcing member 3). In other words, the first joint portion 11 is a portion where the second flat portion 2*c* and the reinforcing member 3 overlapped on the second flat portion 2*c* are welded, and the second joint portion 12 is a portion where the first flat portion 2*b* and the reinforcing member 3 overlapped on the first flat portion 2*b* are welded. In the first joint portion 11 and the second joint portion 12, a plurality of first and second welding spots 11*a* and 12*a* aligned along the longitudinal direction are provided, whereby the main body member 2 and the reinforcing member 3 are joined.

FIG. 2 is a bottom view when the overlapped blank 1 is viewed from the direction of the arrow II in FIG. 1, illustrating only one side of the center line C1 of the overlapped blank 1. As shown in FIG. 2, an interval W1 between the first welding spots 11*a* adjacent to each other in the longitudinal direction of the first joint portion 11 may be larger than an interval W2 between the second welding spots 12*a* adjacent to each other in the longitudinal direction of the second joint portion 12. In the present embodiment, the interval W1 between the first welding spots 11*a* of the first joint portion 11 is, for example, 50 mm, and the interval W2 between the second welding spots 12*a* of the second joint portion 12 is, for example, 25 mm. By setting the smaller distance between the welding spots, the joining strength of the second joint portion 12 is increased as compared with the joining strength of the first joint portion 11.

FIG. 3 is a cross-sectional view taken along the line III-III of FIG. 1, illustrating only one side of the center line C1 of the overlapped blank 1. As shown in FIG. 3, the excess portion 2*a* of the present embodiment has an arc-like cross-sectional shape. The excess portion 2*a* is a portion where the main body member 2 is spaced apart from the upper surface of the reinforcing member 3. A gap S1 is formed between the main body member 2 and the reinforcing member 3 by the excess portion 2*a*. Since the excess portion 2*a* extends in the longitudinal direction, the gap S1 also extends in the longitudinal direction in a similar manner to the excess portion 2*a*. The excess portion 2*a* has a first rising portion 2*d* and a second rising portion 2*e* spaced apart from the upper surface of the reinforcing member 3 at both ends in the width direction, and a central portion 2*f* between the first and second rising portions 2*d* and 2*e*.

The central portion 2*f* extends in an arc-like shape having a curvature radius R1 around a curvature center 01 located on a lower side (inner side of the bending) of the reinforcing member 3. The first rising portion 2*d* is formed in an arc-like shape extending from a position on an outer side of the first welding spot 11*a* of the first joint portion 11 in the width direction, in a direction away from the reinforcing member 3 (upper side of the bending). The second rising portion 2*e* is formed in an arc-like shape extending from a position on an inner side of the second welding spot 12*a* of the second joint portion 12 in the width direction, in a direction away from the reinforcing member 3.

The first rising portion 2*d* and the second rising portion 2*e* have a curvature radius R2 centered on a curvature center 02 located on an upper side (outer side of the bending) of the main body member 2. The central portion 2*f* and the upper surface of the main body member 2 are smoothly connected by the first rising portion 2*d* and the second rising portion 2*e*. The curvature radius R2 of the first rising portion 2*d* and the second rising portion 2*e* is set to be smaller than the curvature radius R1 of the central portion 2*f*.

The curvature radius R2 of the first and second rising portions 2*d*, 2*e* of the present embodiment is set to, for example, 5.0 mm. The curvature radius R1 of the central portion 2*f* of the present embodiment is set to, for example, 13.7 mm. In the present embodiment, the protruding amount t3 of the excess portion 2*a* from the upper surface of the main body member 2 is set to, for example, 6 mm or less. When the protrusion amount t3 is greater than 6 mm, the excess portion may fall sideways and be folded over when the excess portion is crushed during molding. In addition, when the protrusion amount t3 is greater than 6 mm, the excess portion may remain without disappearing in the state of the molded product. The protrusion amount t3 is a height from the upper surface of the second flat portion 2*c* of the main body member 2 where the second welding spots 12*a* of the second joint portion 12 are provided to the upper end of the central portion 2*f* of the excess portion 2*a*. In the present embodiment, the excess portion 2*a* is defined by an arc, but the present invention is not limited thereto, and a parabola or the like may be used.

A difference (L1−L0) between a cross-sectional length L1 and a linear length L0 of the excess portion 2*a* in the cross section orthogonal to the longitudinal direction is greater than the difference ΔL between the line length change margin before and after the bending of the main body member 2 and the line length change margin before and after the bending of the reinforcing member 3 in a case where no excess portion is provided. As used herein, the cross-sectional length L1 is a length from the inner end in the width direction of the first rising portion 2*d* of the excess portion 2*a* to the outer end in the width direction of the second rising portion 2*e*. The line length change margin ΔL may be a difference between the distance L12 (see FIG. 6) between the welding spot 11*a* of the first joint portion 11 of the main body member 2 and the welding spot 12*a* of the second joint portion 12 after the bending, and the distance L13 (see FIG. 6) between the welding spot 11*a* of the first joint portion 11 of the reinforcing member 3 and the welding spot 12*a* of the second joint portion after the bending.

More specifically, the length (cross-sectional length) of the excess portion 2*a* in the cross section orthogonal to the longitudinal direction satisfies the following relationship.

$$L0+0.65(t1+t2) \leq L1 \leq L0+1.35(t1+t2) \quad \text{[Math. 2]}$$

L0: a linear distance of the excess portion

L1: a length of the excess portion t1: a plate thickness of the first metal plate t2: a plate thickness of the second metal plate In the present embodiment, the plate thickness t1 of the main body member 2 is, for example, 1.4 mm. The plate thickness t2 of the reinforcing member 3 is, for example, 1.4 mm.

Figure 4:
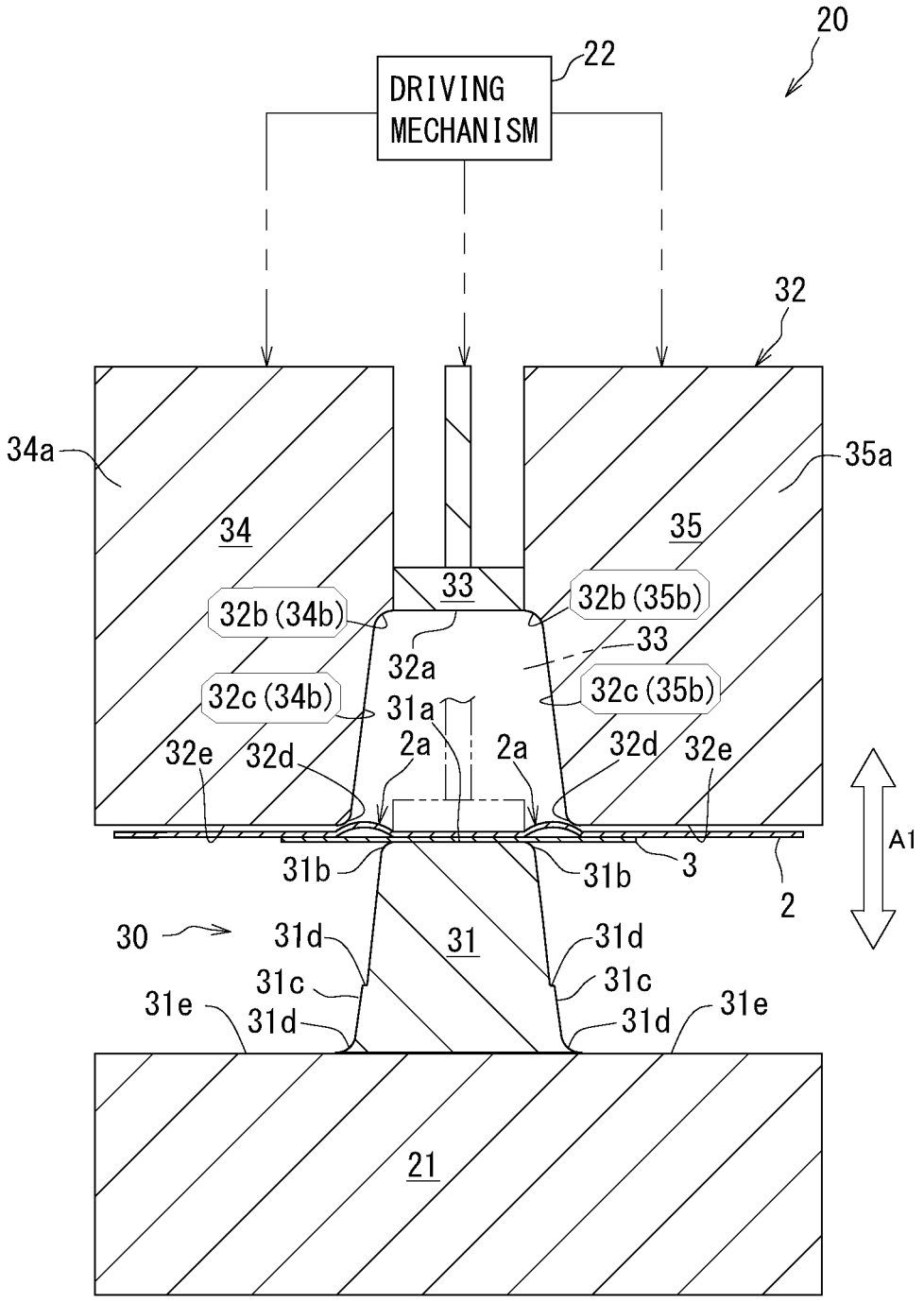
FIG. 4 is a cross-sectional view schematically showing a molding apparatus that carries out a method for molding a press-molded product of an overlapped blank according to an embodiment of the present invention.

With reference to FIG. 4, the press molding apparatus 20 is an apparatus that press-molds the overlapped blank 1 having a plate-like shape into a hat shape.

The press molding apparatus 20 of the present embodiment includes a fixing base 21, a mold 30, and a drive mechanism 22. The mold 30 includes a punch 31 and a die 32. The detailed configuration of the drive mechanism 22 is identical to that generally used in the press molding apparatus 20, and therefore detailed description and illustration thereof are omitted.

The fixing base 21 is fixed and immovable. The punch 31 is attached to the fixing base 21 so as to protrude upward. Therefore, the punch 31 is also fixed and immovable. The die 32 is driven to move up and down in the vertical direction by the operation of the hydraulic or mechanical drive mechanism 22 (see an arrow A1). The drive mechanism 22 can stop up-and-down movement of the die 32 and maintain a pressurized state.

The punch 31 has a convex shape. The punch 31 includes a punch top portion 31*a*, a pair of left and right punch shoulder portions 31*b* provided at both ends of the punch top portion 31*a*, and a punch side portion 31*c* extending obliquely downward from each of the punch shoulder portions 31*b*. The punch top portion 31*a* is a horizontal flat surface, and the width of the punch top portion 31*a* is smaller than the width of the reinforcing member 3 (overlapped portion 4) of the overlapped blank 1. When the center of the punch top portion 31*a* of the punch 31 in the width direction and the center portion of the overlapped blank 1 in the width direction are arranged to coincide with each other at the time of molding, the overlapped portion 4 is arranged from the punch top portion 31*a* to the punch side portion 31*c*.

The punch side portion 31*c* is a flat surface with a step 31*d*. The height of the step 31*d* substantially corresponds to the thickness t2 of the reinforcing member 3. Therefore, the surface of the punch 31 is lowered by one step from the punch shoulder portion 31*b* to the step 31*d* in accordance with the size of the reinforcing member 3.

The punch side portion 31*c* forms a corner portion 31*e* together with the fixing base 21. The fixing base 21 constitutes a flange surface portion 31*f* via the corner portion 31*e*. The flange surface portion 31*f* is a flat surface extending outward in the horizontal direction.

The die 32 has a concave shape inside. The die 32 includes a first die (pad) 33 located at the center, and a second die 34 and a third die 35 located on both sides of the first die 33. The first die 33 and the second and third dies 34 and 35 can be moved up and down at different timings by the drive mechanism 22.

The first die 33 has a rectangular shape in a front view and extends in the vertical direction. The first die 33 constitutes a concave die bottom surface 32*a* of the die 32, and has a horizontal flat surface facing the punch top portion 31*a*. At the time of the press molding, as indicated by a two-dot chain line, the first die 33 first moves down and comes into contact with the overlapped blank 1. The width of the die bottom surface 32*a* is smaller than the width between the excess portions 2*a*. Therefore, the excess portion 2*a* is not deformed at a stage where the overlapped blank 1 is clamped by the die bottom surface 32*a* and the punch top portion 31*a* during the press molding.

Figure 5:
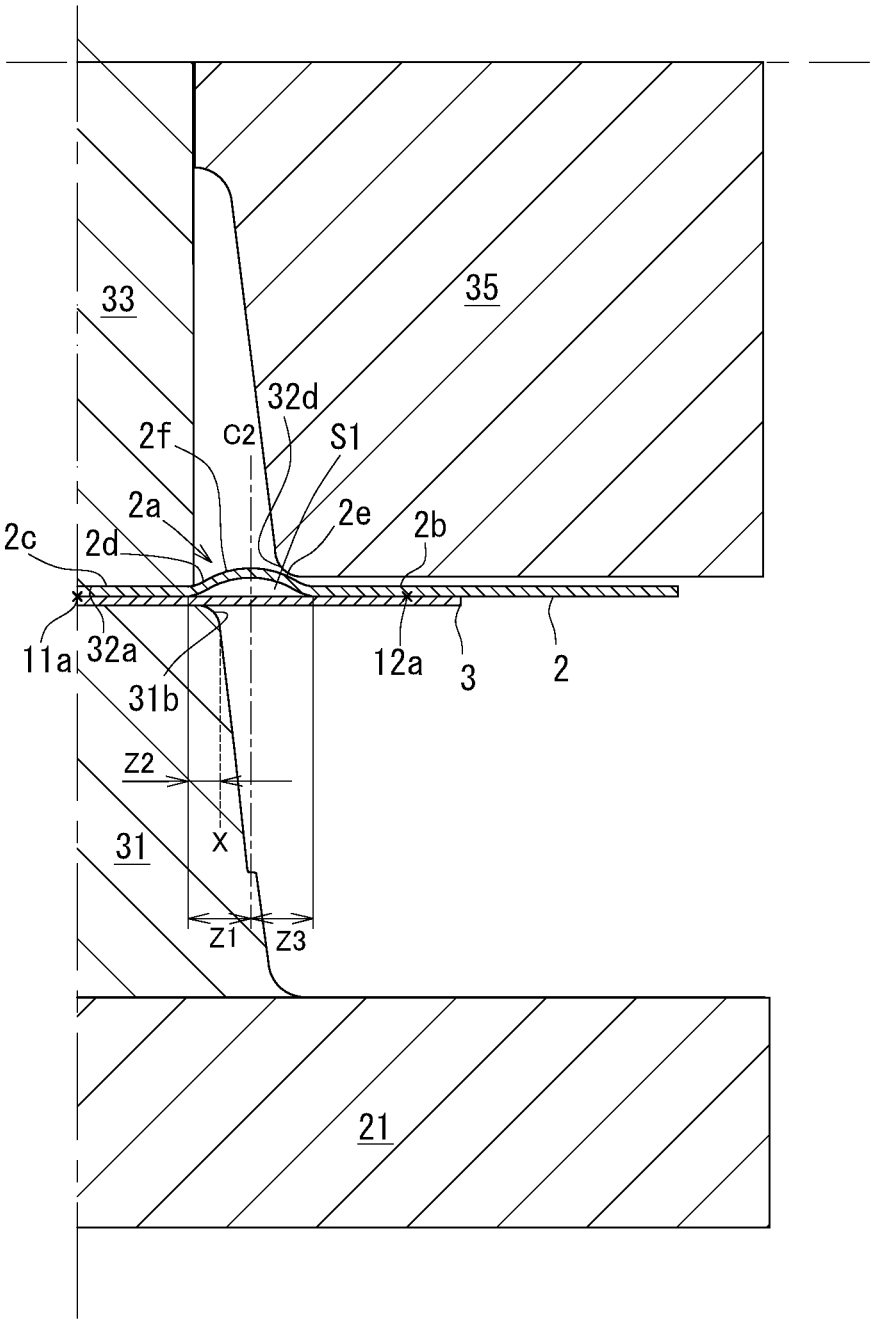
FIG. 5 is a cross-sectional view illustrating a punch, a die, and an overlapped blank prior to bending.

As shown in FIG. 5, the width of the die bottom surface 32*a* is set so that the position in the width direction overlaps with the pair of first welding spots 11*a* in the width direction. Therefore, at the time of press molding, the space between the pair of first welding spots 11*a* in the width direction is bound by the first die 33 and the punch top portion 31*a*, and deformation between the pair of first welding spots 11*a* in the width direction is suppressed. As a result, at the time of press molding, the line length change margin ΔL between the main body member 2 and the reinforcing member 3 between the first welding spot 11*a* and the second welding spot 12*a* is likely to be absorbed by the excess portion 2*a*.

The second die 34 and the third die 35 have a substantially inverted L-shape in a front view. The second die 34 and the third die 35 include base portions 34*a*, 35*a* extending in the vertical direction, and cutout portions 34*b* and 35*b* obtained by cutting out a part of the surface on the inner side in the width direction (the side directed to the first die 33) of each of the base portions 34*a*, 35*a*. The cutout portions 34*b*, 35*b* are continuously formed in the longitudinal direction.

The cutout portions 34*b*, 35*b* constitute a concave die shoulder portion 32*b* of the die 32 and a die side portion 32*c* extending obliquely downward from the die shoulder portion 32*b*. The die side portion 32*c* is a flat surface. The die side portion 32*c* is formed to face and to be substantially parallel to the punch side portion 31*c*.

To a lower end of the die side portion 32*c*, a shoulder curved portion 32*d* and, via the shoulder curved portion 32*d*, a flange surface portion 32*e* are connected. The flange surface portion 32*e* is a flat surface extending outward in the width direction that faces the flange surface portion 31*f* of the fixing base 21.

Next, with reference to FIGS. 4 to 7, a molding method of the overlapped blank 1 is described. FIGS. 4 to 7 sequentially illustrate steps of the molding method of the overlapped blank 1 according to the present embodiment. Note that, in FIGS. 5 to 7, only a cross section on one side in the width direction of the overlapped blank 1 and the mold 30 is illustrated for clarity of illustration.

First, the overlapped blank 1 in which the main body member 2, having the excess portion protruding upward, and the flat reinforcing member 3 are overlapped and joined is prepared, and the overlapped blank 1 is bent in a state where the main body member 2 is arranged to the outer side of the bending of the overlapped blank 1. The press molding may be either so-called cold press molding performed at room temperature or the like, or hot press molding such as hot stamping.

FIG. 4 shows a preparation step. In the preparation step, the overlapped blank 1 is set in the mold 30. At this moment, in the overlapped blank 1, the main body member 2 is arranged on the upper side. With such an arrangement, the excess portion 2*a* is arranged on the upper side of the bending where a line length change is great.

Figure 6:
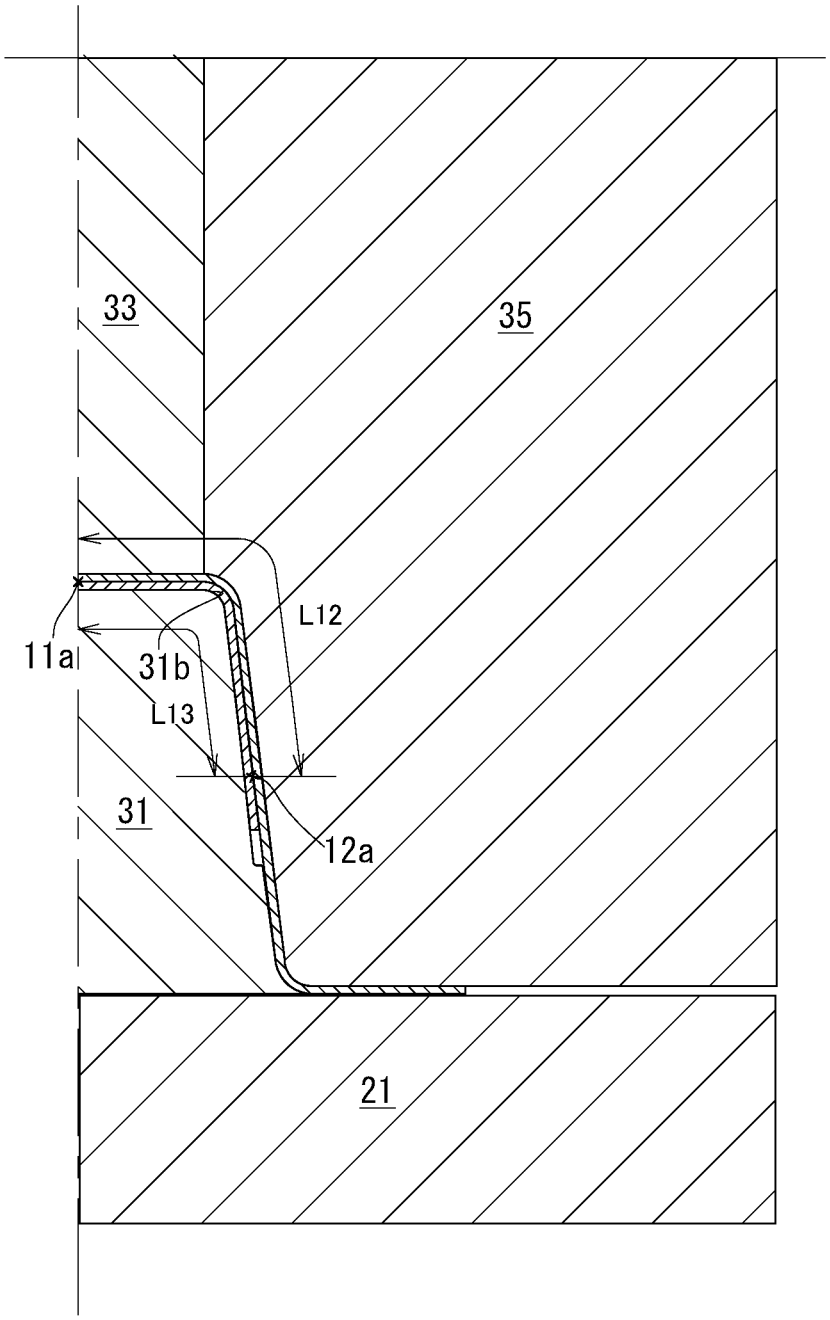
FIG. 6 is a cross-sectional view showing a state in which the overlapped blank is pressed with a punch and a die (bottom dead center)

FIGS. 5 and 6 show a bending step of carrying out the bending. FIG. 5 shows before the bending, and FIG. 6 shows after the bending.

As shown in FIG. 5, in the state before the bending, the first die 33 is lowered by the drive mechanism 22 (see FIG. 4), whereby the die bottom surface 32*a* of the first die 33 comes into contact with the overlapped portion 4 of the overlapped blank 1. The overlapped portion 4 is thus sandwiched between the punch top portion 31*a* of the punch 31 and the die bottom surface 32*a* of the die 32. At this moment, the overlapped blank 1 is arranged such that at least a part of the excess portion 2*a* overlaps the punch shoulder portion 31*b* of the punch 31.

Specifically, a region Z1 on the inner side in the width direction with respect to the center line C2 in the width direction of the excess portion 2*a* is arranged to be on the inner side in the width direction with respect to the punch shoulder portion 31*b*. More preferably, the first rising portion 2*d* of the excess portion 2*a* is located in a region Z2 on the inner side in the width direction with respect to the straight line X indicated by a dashed line in FIG. 5 passing through the curvature end on the outer side in the width direction of the punch shoulder portion 31*b*. During bending of the overlapped blank 1, the central portion in the width direction of the overlapped blank 1, more specifically a portion between the pair of excess portions 2*a* in the width direction, is bound by the punch top portion 31*a* of the punch 31 and the die bottom surface 32*a* of the first die 33.

In the state before the bending, the second die 34 and the third die 35 are lowered by the drive mechanism 22 (see FIG. 4), whereby the shoulder curved portions 32*d* of the second die 34 and the third die 35 come into contact with the overlapped blank 1. Specifically, the shoulder curved portions 32*d* of the second die 34 and the third die 35 abut on a region 23 on the outer side in the width direction with respect to the center line C2 in the width direction of the excess portion 2*a*. More preferably, the shoulder curved portions 32*d* abut on a portion of the central portion 2*f* of the excess portion 2*a* on the second rising portion 2*e* side.

Thereafter, as shown in FIG. 6, the second die 34 and the third die 35 are lowered to the bottom dead center (the lower end position of the die 32 at which the bending is completed), whereby the overlapped blank 1 is bent. The deformation of the overlapped blank 1 and the change in the stress distribution generated in the overlapped blank 1 during the bending are described in detail later.

Figure 7:
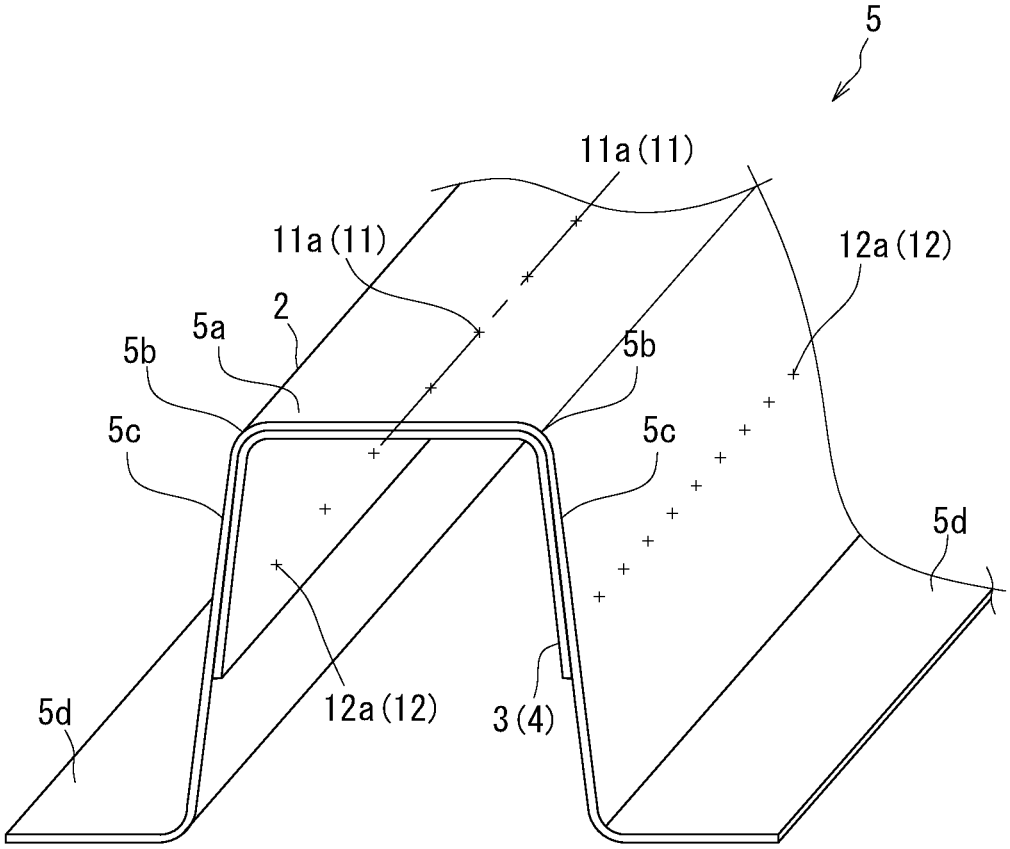
FIG. 7 is a perspective view of a molded article molded by the method for molding an overlapped blank according to the embodiment of the present invention.

In this way, the hat-shaped press-molded product 5 as shown in FIG. 7 can be manufactured. The press-molded product 5 includes a top surface portion 5*a*, shoulder portions 5*b* on both sides in the width direction of the top surface portion 5*a*, a vertical wall portion 5*c* inclined outward in the width direction toward a lower side from the shoulder portion 5*b*, and a flange portion 5*d* extending outward in the width direction from a lower end of the vertical wall portion 5*c*.

The reinforcing member 3 is provided on the inner surface side of the press-molded product 5 so as to span over the top surface portion 5*a* and the vertical wall portion 5*c*. In other words, the overlapped portion 4 is formed to span over the top surface portion 5*a* and the vertical wall portion 5*c*. In the state of the press-molded product 5, the welding spot 11*a* of the first joint portion 11 is located at the top surface portion 5*a* while the welding spot 12*a* of the second joint portion 12 is located at the vertical wall portion 5*c*, whereby the gap S1 formed by the excess portion 2*a* disappears.

Figure 8:
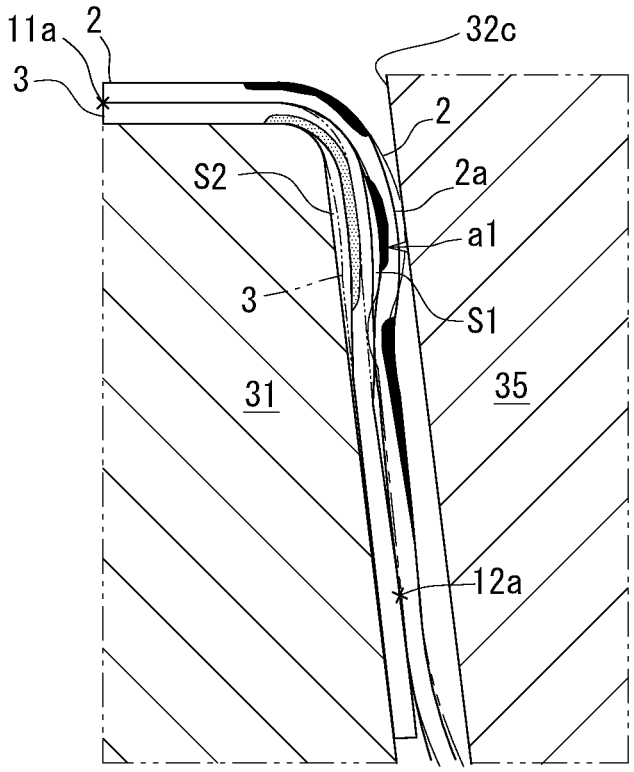
FIG. 8 is a stress distribution diagram in a state where the overlapped blank is pressed with a punch and a die (bottom dead center raised by 18 mm)
Figure 9:
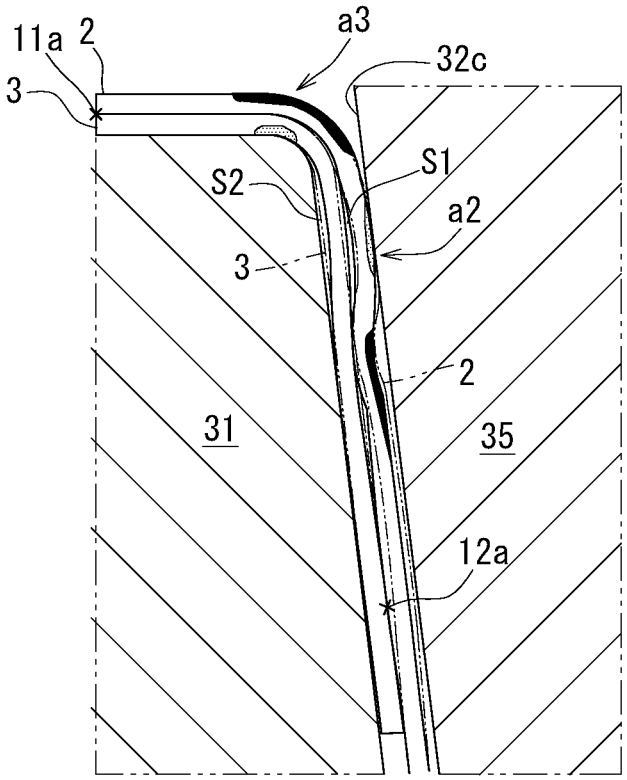
FIG. 9 is a stress distribution diagram in a state where the overlapped blank is pressed with a punch and a die (bottom dead center raised by 8 mm)
Figure 10:
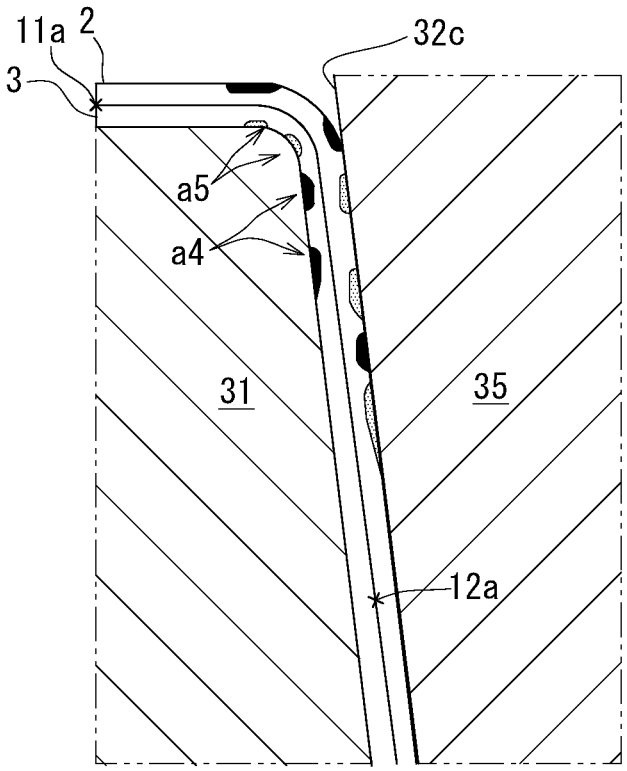
FIG. 10 is a stress distribution diagram at the bottom dead center of the overlapped blank.

Next, with reference to FIGS. 8 to 10, the stress distributions generated in the main body member 2 and the reinforcing member 3 at the time of bending are described. In FIGS. 8 to 10, the portion to which the tensile stress is applied is shown in dark color, and the portion to which the compressive stress is applied is shown in light color. FIG. 8 shows a stress distribution in a state where the line length change is absorbed by the excess portion 2*a* (in the present embodiment, for example, the die 32 is positioned 18 mm above the bottom dead center). FIG. 9 shows a stress distribution in a state where the excess portion 2*a* is compressively deformed by the die 32 (in the present embodiment, for example, the die 32 is positioned 8 mm above the bottom dead center). FIG. 10 shows a stress distribution in a state where the die 32 is positioned at the bottom dead center. Note that, in FIGS. 8 to 10, only the overlapped blank 1 and the vicinity of the shoulder portion of the mold 30 are shown in an enlarged manner for clarity of illustration.

In FIG. 8, a portion (first flat portion 2*b*) on the outside of the excess portion 2*a* of the overlapped blank 1 is pushed down by the shoulder curved portion 32*d* of the third die 35, whereby bending deformation is caused. Therefore, at the time of being located 18 mm above the bottom dead center as shown in FIG. 8, the surface of the excess portion 2*a* on the outer side of the bending (the surface on the side opposite to the reinforcing member 3) and the third die 35 are not in contact with each other, whereby tensile stress (see the arrow a1) is generated on the surface of the excess portion 2*a* on the inner side of the bending (the surface on the side of the reinforcing member 3), and the main body member 2 is deformed such that the excess portion 2*a* is stretched in the vertical direction. As a result, the gap S1 provided between the main body member 2 and the reinforcing member 3 by the excess portion 2*a* is reduced.

At this time, since the reinforcing member 3 is bound to the main body member 2 at the first joint portion 11 and the second joint portion 12, the reinforcing member 3 follows deformation of the excess portion 2*a* (deformation of the excess portion 2*a* being stretched in the vertical direction). As a result, the compressive stress due to the bending deformation generated in the portion of the reinforcing member 3 to be the shoulder portion after molding is reduced as compared with the case where the reinforcing member 3 is deformed so as to conform to the shape of the punch 31 without the second joint portion 12 being provided as indicated by an imaginary line in FIG. 8. At this time, the reinforcing member 3 does not conform to the shape of the punch 31, and a gap S2 is generated between the reinforcing member 3 and the punch 31.

As shown in FIG. 9, as the bending further progresses, the excess portion 2*a* of the main body member 2 remaining after the line length change is compressively deformed by the die side portion 32*c* of the descending third die 35 such that the gap S1 between the excess portion 2*a* and the reinforcing member 3 disappears (is crushed), and the compressive stress (see the arrow a2) is generated on the surface of the excess portion 2*a* on the outer side of the bending. As a result, as compared with the case where the main body member 2 is not provided with the excess portion 2*a* remaining after the line length change, the tensile stress (see the arrow a3) due to the bending deformation generated in the portion of the body member 2 to be the shoulder portion after molding is reduced. At this time, the gap S2 between the reinforcing member 3 and the punch 31 remains.

As shown in FIG. 10, when the die 32 reaches the bottom dead center, the reinforcing member 3 is compressively deformed by the die side portion 32*c* of the descending third die 35 such that the gap S2 between the reinforcing member 3 and the punch 31 disappears (is crushed), a compressive stress is generated on the surface of the reinforcing member 3 on the main body member 2 side, and a tensile stress (see the arrow a4) is generated on the surface of the reinforcing member 3 on the opposite side of the main body member 2. As a result, the compressive stress (see the arrow a5) generated in the portion of the reinforcing member 3 to be the shoulder portion after molding is reduced by the tensile stress generated in the portion of the reinforcing structure 3 to be the vertical wall portion after molding.

As described above, by providing the excess portion 2*a*, compressive stress is generated in the vertical wall portion of the main body member 2 and tensile stress in the punch shoulder portion 31*b* is reduced. By providing the joint portion in the vertical wall portion, the tensile stress in the punch shoulder portion decreases and the compressive stress increases in the vertical wall portion in the main body member 2. In addition, in the reinforcing member 3, the compressive stress in the punch shoulder portion is reduced, and the tensile stress is generated in the side wall portion. Accordingly, springback upon releasing is suppressed.

Due to the above configuration, the molding method of the overlapped blank 1 according to the present embodiment produces the following effects.

Upon bending of the overlapped blank 1, the main body member 2 and the reinforcing member 3 are bound to each other by the first joint portion 11 and the second joint portion 12. Therefore, as the bending progresses, compressive stress tends to be generated in the reinforcing member 3 on the inner side of bending, while tensile stress tends to be generated in the main body member 2 on the outer side of bending due to the line length difference. For this reason, a shear stress is generated at the first welding spot 11*a*, and a large load is applied to the joint portions 11, 12 of the main body member 2 and the reinforcing member 3, leading to a risk of rupture of the first welding spot 11*a*. In addition, when the load is removed and the product is released after the process of bending, elastic recovery that restores the shape, so-called springback, is caused, and the shape of the press-molded product may not match the desired shape.

In the present embodiment, since the excess portion 2*a* is provided between the first joint portion 11 and the second joint portion 12, it is possible to absorb the strain caused by the linear length difference between the first joint portion 11 and the second joint portion 12 of, the main body member 2 and the reinforcing member 3 by the deformation of the excess portion 2*a* and to reduce the shear stress generated in the joint portion at the time of press molding for bending the overlapped blank 1, whereby it is possible to avoid rupture of the first welding spot 11*a*.

Since the main body member 2 is deformed such that the excess portion 2*a* is stretched at the time of bending, tensile stress due to bending is suppressed as compared with a case where no excess portion is provided, and springback can be suppressed. Furthermore, due to crush and deformation of the excess portion 2*a*, compressive stress is generated in the main body member 2. This compressive stress cancels a part of the tensile stress of the main body member 2 that causes the springback, whereby the springback of the overlapped blank 1 can be further suppressed.

Since the reinforcing member 3 is bound to the main body member 2, tensile stress (see the arrow a1 in FIG. 8) caused by follow-up to deformation of the excess portion 2*a* of the main body member 2 is generated in the reinforcing member 3 in addition to compressive stress generated at the time of bending. This cancels a part of the compressive stress of the reinforcing member 3 that causes the springback, whereby the springback of the overlapped blank 1 is suppressed.

Since the bending deformation of the reinforcing member 3 in the compression direction between the first and second joint portions 11 and 12 of the overlapped blank 1 is suppressed by the tensile stress, the gap S2 is generated between the reinforcing member 3 and the punch side portion 31*c* facing the reinforcing member 3 in the first half of the press molding process.

As the bending deformation progresses, the reinforcing member 3 is deformed inward in the width direction so as to disappear the gap S2, whereby tensile stress (see the arrow a4 in FIG. 10) is further generated on the surface of the reinforcing structure 3 on the inner side of the bending. This cancels a part of the compressive stress of the reinforcing member 3 that causes the springback, whereby the springback of the overlapped blank 1 is further suppressed.

The difference (L1−L0) between the cross-sectional length L1 and the linear length L0 of the excess portion 2*a* is greater than the difference ΔL between the line length change margin before and after the bending of the main body member 2 and the line length change margin before and after the bending of the reinforcing member 3 in a case where no excess portion is provided, whereby the excess portion 2*a* remaining after the line length change is compressively deformed by the mold 30. Consequently, since compressive stress (see the arrow a2 in FIG. 9) is generated in the main body member 2 in addition to the tensile stress generated by the bending, a part of the tensile stress of the main body member 2 (see the arrow a3 in FIG. 9) that causes springback is canceled by the compressive stress, whereby the springback of the overlapped blank 1 is suppressed.

Since the length L1 of the excess portion 2*a* is set to L0+0.65 (t1+t2) or more and L0+1.35 (t1+t2) or less when the plate thickness of the main body member 2 is t1 and the plate thickness of the reinforcing member is t2, it is possible to suppress the springback of the overlapped blank 1 while avoiding the rupture of the joint portions 11, 12.

Specifically, when the length of the excess portion is less than L0+0.65 (t1+t2), it is difficult to obtain a favorable effect of suppressing rupture of the joint portion and springback. When the length of the excess portion is greater than L0+1.35 (t1+t2), the excess portion of the first metal plate excessively remains, and when the excess portion is deformed to a predetermined shape, a shear stress is generated in the joint portion between the first metal plate and the second metal plate, and the joint portion may be ruptured.

The main body member 2 and the reinforcing member 3 are formed of steel plates, for example high-tensile steel plates, and thus suitably exert the effect when applied to a steel plate having high strength in which springback tends to be large.

Even when the main body member 2 and the reinforcing member 3 are joined to each other by spot welding in which the strength of the joint portion is lower than that of line welding, rupture of the joint portions 11 and 12 can be suppressed, whereby cost can be reduced as compared with line welding.

Since the overlapped blank 1 is arranged such that at least a part of the excess portion 2*a* overlaps the punch shoulder portion 31*b*, absorption of line length change and reduction in tensile stress by the excess portion 2*a* are more easily achieved.

The present invention has been described with reference to the above-described embodiment; however, the present invention is not limited to the above-described embodiment.

In the present embodiment, it has been described that the main body member 2 and the reinforcing member 3 are high-tensile steel plates having a tensile strength of 590 MPa or more; however, the present invention is not limited thereto, and the main body member 2 and the reinforcing member 3 may be metal plates made of an aluminum alloy, steel plates, high-tensile steel plates having a tensile strength of less than 590 MPa, or the like.

In the present embodiment, it has been described that the plate thicknesses t1 and t2 of the main body member 2 and the reinforcing member 3 are both 1.4 mm; however, the present invention is not limited thereto, and the plate thicknesses t1 and t2 may be different from each other.

In the present embodiment, it has been described that the central portion in the width direction of the main body member 2 and the central portion in the width direction of the reinforcing member 3 coincide with each other in position; however, the present invention is not limited thereto and the central portion of the reinforcing member 3 may be arranged to be misaligned with respect to the central portion of the main body member 2 in the width direction. For example, the reinforcing member 3 may be provided only on a shoulder portion on one side of a hat-shaped molded article.

In the present embodiment, it has been described that the reinforcing member 3 is narrower than the main body member 2; however, the present invention is not limited thereto, and the reinforcing member 3 may have a width greater than or equal to the width of the main body member 2.

Figure 11:
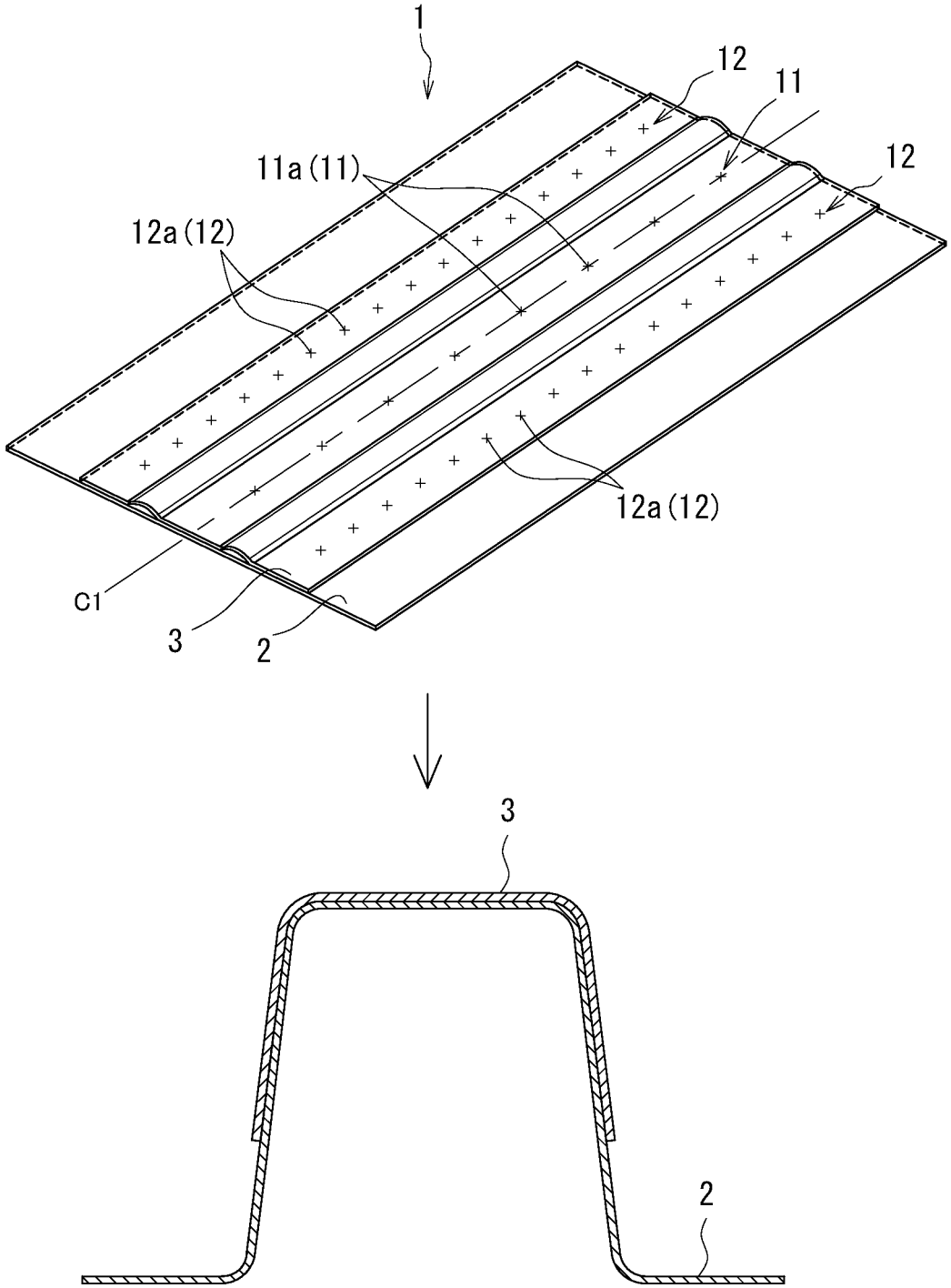
FIG. 11 is a perspective view and a cross-sectional view after molding illustrating a modification of the overlapped blank.

In the present embodiment, it has been described that the reinforcing member 3 is overlapped on the inner side of the main body member 2; however, the present invention is not limited thereto, and the reinforcing member 3 may be overlapped with the outer side of the main body member 2 as shown in FIG. 11. In this case, it is sufficient that the reinforcing member 3 is the first metal plate, the main body member 2 is the second metal plate, and the reinforcing member 3 is provided with the excess portion.

In the present embodiment, it has been described that the interval W1 of the first welding spots 11*a* of the first joint portion 11 is greater than the interval W2 of the second welding spots 12*a* of the second joint portion 12; however, the present invention is not limited thereto, and the interval W1 of the first joint portion 11 and the interval W2 of the second joint portion 12 may be the same, or the first joint portion 11 located on the top surface portion 5*a* of the molded product may not be provided. When there is no problem in member strength and the first joint portion 11 is not provided, it is sufficient that a reference hole is provided and displacement in the width direction is restrained with a locate pin.

EXAMPLES

Table 1 shows results of analysis of the rupture of the joint portions of the overlapped blanks of Comparative Example 1 and Example 1. With each of the overlapped blanks of Comparative Example 1 and Example 1, a hat-shaped press-molded product was obtained by cold press molding of high-tensile steel plates having a tensile strength of 980 MPa as the main body member and the reinforcing member. Regarding the effect of suppressing the rupture of the joint portion, an evaluation was made as to whether or not an element disappeared during the analysis when the welding spot reached a predetermined rupture determination criterion.

Comparative Example 1 was an overlapped blank according to a conventional example in which a joint portion was provided on a side wall portion and no excess portion was provided. Example 1 was an overlapped blank according to the embodiment of the present invention in which an excess portion and a joint portion on a side wall portion were provided.

TABLE 1

| | Comparative Example 1 | Example 1 |
|---|---|---|
| Excess portion | Not provided | Provided |
| Joint portion | Provided | Provided |
| Rupture of joint portion after molding | Provided | Not provided |

As can be seen from Table 1, in Comparative Example 1 in which no excess portion was provided, the joint portion was ruptured after molding. On the other hand, in Example 1 in which the excess portion was provided, the joint portion was not ruptured even after molding. Therefore, due to the excess portion provided in the main body member, a strain difference generated between the main body member and the reinforcing member during molding was alleviated and stress applied to the joint portion was reduced, whereby rupture of the joint portion on the side wall portion was avoided.

Figure 12:
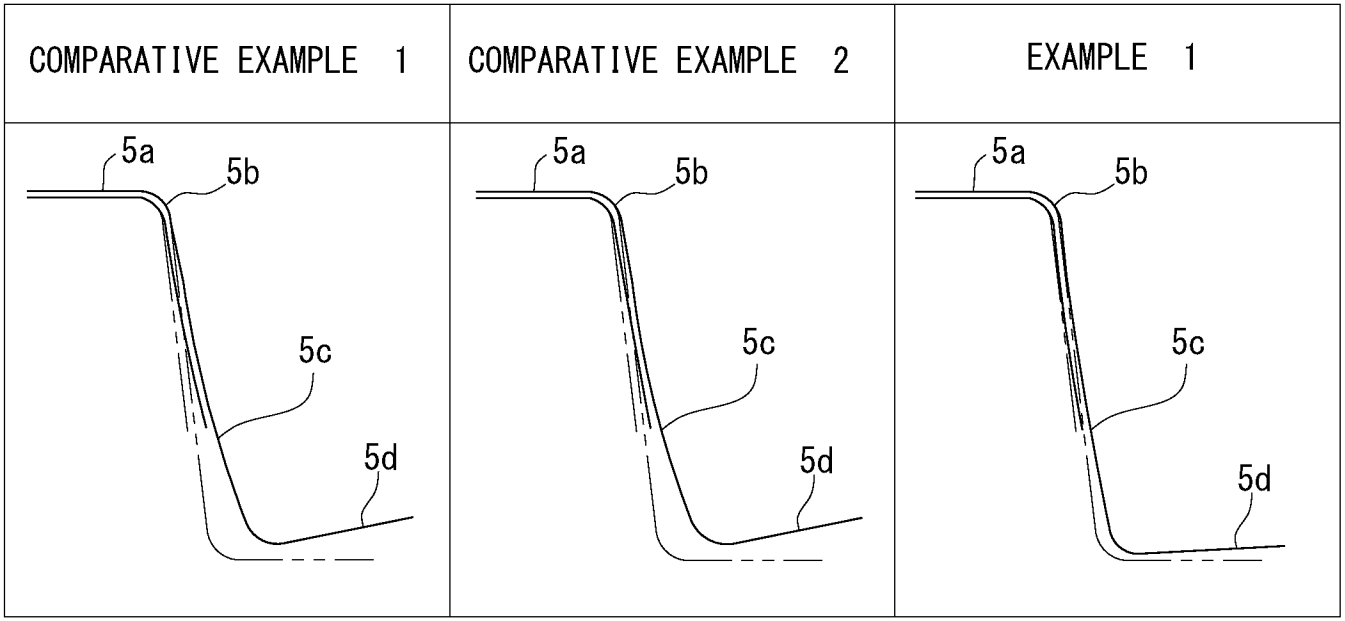
FIG. 12 is a schematic view showing an analysis result of springback of the overlapped blanks according to comparative examples and an example.

FIG. 12 schematically illustrates a result of analysis of the springback amount after molding with regard to the overlapped blanks of Comparative Examples 1, 2 and Example 1. With each of the overlapped blanks of Comparative Examples 1, 2 and Example 1, a hat-shaped press-molded product was obtained by cold press molding of high-tensile steel plates having a tensile strength of 980 MPa as the main body member and the reinforcing member. The effect of suppressing the springback was evaluated after molding the overlapped blank into a hat shape, on the basis of the difference between a result of the spring-back analysis (solid line) and the shape at the bottom dead center (two-dot chain line) being overlapped with each other.

Comparative Example 1 and Example 1 were the same as the conditions of Comparative Example 1 and Example 1 shown in Table 1; however, since the joint portion was ruptured after molding, in Comparative Example 1, the analysis was made without providing the joint portion of the side wall portion. Comparative Example 2 was an overlapped blank according to a conventional example in which the excess portion was provided and no joint portion was provided on a side wall portion.

As is apparent from FIG. 11, in Example 1, the difference between the shape of the molded article at the bottom dead center in the vertical wall portion 5*c* and the flange portion 5*d* (two-dot chain line) and the shape after the springback (solid line) was reduced as compared with Comparative Example 1, indicating that the springback amount was suppressed. It can thus be seen that Example 1 was also effective in suppressing the springback. In Comparative Example 2 in which the excess portion was provided and no joint portion was provided in the side wall portion, no large difference was observed between the shape of the molded product at the bottom dead center (two-dot chain line) and the shape after the springback (solid line) in the vertical wall portion 5*c* and the flange portion 5*d*, thus showing no significant effect of suppressing the springback amount. Therefore, it can be seen that due to providing the excess portion and providing the joint portion on the side wall portion as in Example 1, the springback was suppressed.

FIG. 12 shows the results of analysis of the stress change at the bottom dead center when the overlapped blanks of Comparative Examples 1, 2 and Example 1 described above were bent. In FIG. 12, the portion to which the tensile stress was applied is shown in dark color, and the portion to which the compressive stress was applied is shown in light color.

Comparing the results of Comparative Example 1 and Comparative Example 2, it can be seen that the compressive stress (b1) was generated in the side wall portion of the main body member and the tensile stress (b2) in the punch shoulder portion was reduced in Comparative Example 2 as compared with Comparative Example 1 due to providing the excess portion. As a result, it is considered that a part of the tensile stress (b12) generated in the main body member in Comparative Example 1 was canceled by the compressive stress (b1) generated in the main body member. On the other hand, in the reinforcing member 3, no significant change was observed in the compressive stress generated in the shoulder portion.

From the results of Comparative Example 2 and Example 1, by spot-welding of the side wall portion, the tensile stress (b22) in the punch shoulder portion of the main body member was reduced, and the compressive stress (b21) in the side wall portion of the main body member was increased. In addition, in the reinforcing member, the compressive stress (b23) in the punch shoulder portion was reduced, and the tensile stress (b24) was generated in the side wall portion of the reinforcing member. As described above, it can be seen that the springback was suppressed.

Figure 13:
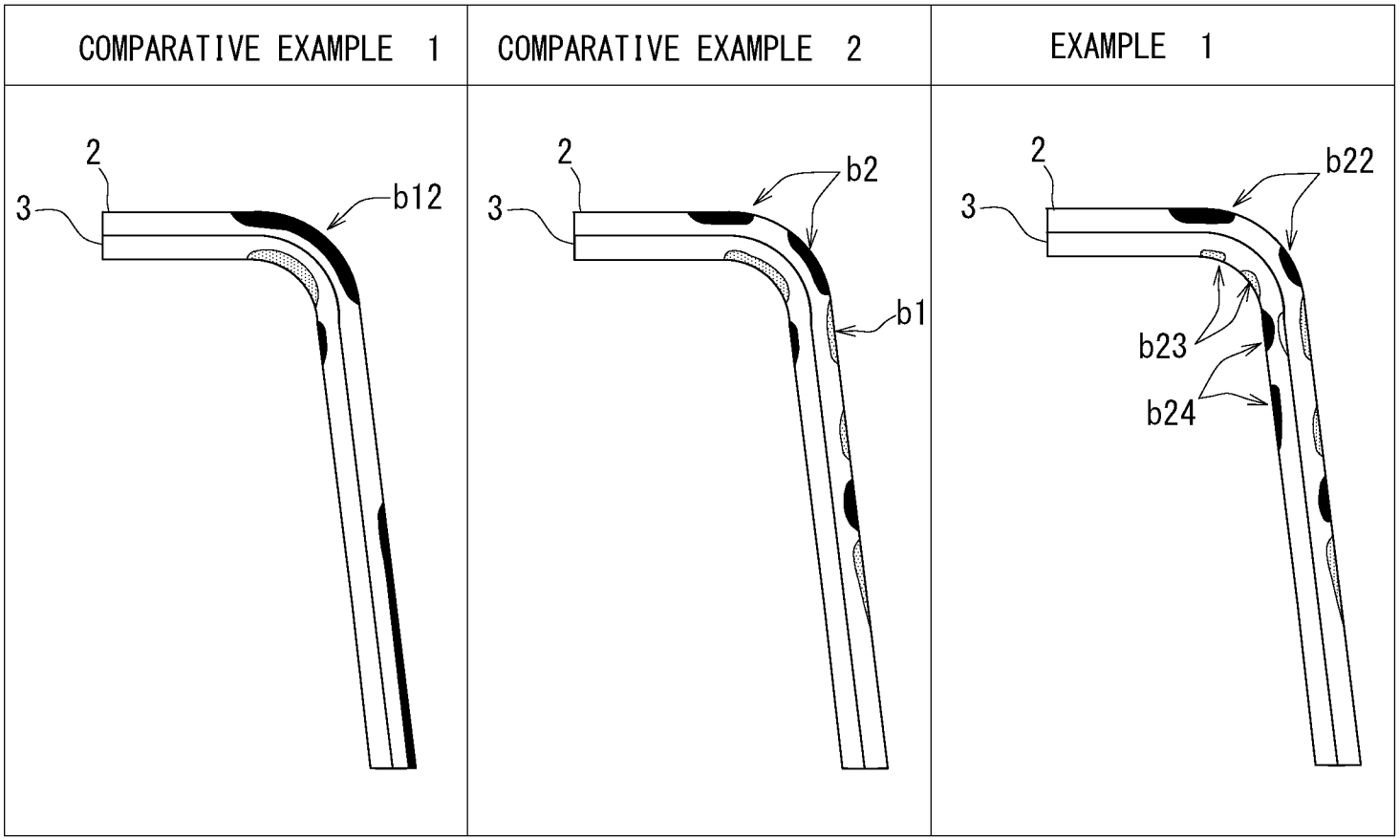
FIG. 13 is a stress distribution diagram at the bottom dead center of the overlapped blanks according to the comparative examples and the example.
Figure 14:
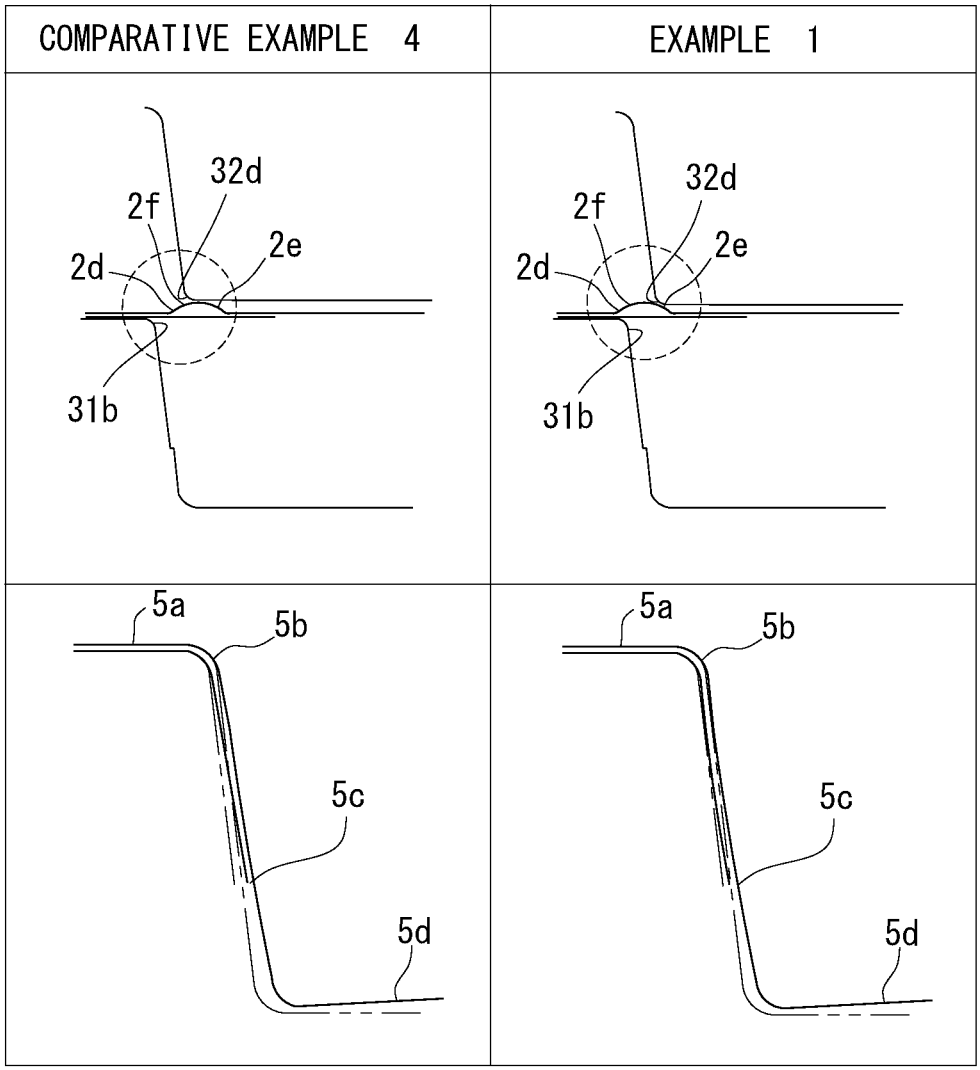
FIG. 14 is a schematic view illustrating an analysis result of springback in a case where the position of the excess portion with respect to the punch shoulder portion is changed.

FIG. 13 shows a result of analysis of the springback amount when the position in the width direction of the excess portion 2*a* of the overlapped blank was changed with respect to the punch shoulder portion 31*b* and the die shoulder portion 32*d*. In Example 1, the overlapped blank was disposed in the mold 30 such that a part of the excess portion 2*a* overlapped the punch shoulder portion 31*b* and that the die shoulder portion 32*d* was positioned on an outer side in the width direction of the center of the excess portion 2*a* in the width direction. In Comparative Example 4, the overlapped blank was disposed in the mold 30 such that the excess portion 2*a* was positioned on an outer side in the width direction of the punch shoulder portion 31*b* and that the die shoulder portion 32*d* was positioned on an inner side in the width direction of the center of the excess portion 2*a* in the width direction. Comparing the results of the springback of Example 1 and Comparative Example 4, as shown in FIG. 13, it can be seen that Example 1 suppressed the springback as compared with Comparative Example 4 although the difference was not significant, and was closer to the shape at the molding bottom dead center (two-dot chain line).

The present invention is not limited to the illustrated embodiment, and various improvements and design changes can be made without departing from the gist of the present invention.

INDUSTRIAL APPLICABILITY

As described in the foregoing, according to the present invention, the overlapped blank and molding method thereof enable prevention of rupture of the welded portion and suppression of springback at the time of press molding for bending a blank including a plurality of metal plates overlapped and joined, and may thus be suitably used in a field of industrial manufacturing such as automobile manufacturing.

What is claimed is:

1. A molding method of an overlapped blank comprising:

preparing an overlapped blank comprising a first metal plate including a bulged excess portion, a first flat portion provided adjacent to the excess portion, and a second flat portion provided adjacent to the excess portion on an opposite side to the first flat portion, a flat second metal plate overlapped on the first flat portion and the second flat portion, a first joint portion where the first flat portion and the second metal plate are joined to each other, and a second joint portion where the second flat portion and the second metal plate are joined to each other; and bending the overlapped blank with the first metal plate being directed to an outer side of the bending of the overlapped blank, wherein in the preparing of the overlapped blank, the excess portion has a cross-sectional length in a cross section and a linear length which is a distance between opposite ends of the excess portion in the cross section; and the cross-sectional length of the excess portion satisfies the following relationship $$L0+0.65(t1+t2)\leq L1\leq L0+1.35(t1+t2)$$

L0: the linear length of the excess portion,

L1: the cross-sectional length of the excess portion, t1: a plate thickness of the first metal plate, and t2: a plate thickness of the second metal plate.

2. The molding method of an overlapped blank according to claim 1, wherein the first metal plate and the second metal plate are steel plates.

3. The molding method of an overlapped blank according to claim 1, wherein the first metal plate and the second metal plate are high-tensile steel plates.

4. The molding method of an overlapped blank according to claim 1, wherein the first metal plate and the second metal plate are joined by spot welding.

5. The molding method of an overlapped blank according to claim 1, wherein the bending comprises:

preparing a punch having a punch shoulder portion with a convex shape for forming a shoulder portion of a molded article and a die having, in an inner portion, a die shoulder portion with a concave shape corresponding to the convex shape;

arranging at least a part of the excess portion of the overlapped blank so as to overlap the punch shoulder portion of the punch; and lowering the die in a relative manner to the punch.

* * * * *